US005751098A

United States Patent [19]

Ito et al.

[11] Patent Number: 5,751,098

[45] Date of Patent: May 12, 1998

[54] STRUCTURE OF COLOR SELECTING ELECTRODE ASSEMBLY FOR COLOR CATHODE RAY TUBES

[75] Inventors: Hideya Ito; Shoji Morimoto; Akira Ichikawa; Junko Itoh; Kenji Kawaguchi, all of Amagasaki; Akira Yamada, Nagasaki; Atsushi Hattori; Hiroyuki Sakaiya, both of Nagaokakyo, all of Japan

[73] Assignee: Mitsubishi Denki Kabushiki Kaisha, Tokyo, Japan

[21] Appl. No.: 543,585

[22] Filed: Oct. 16, 1995

[30] Foreign Application Priority Data

Oct. 25, 1994 [JP] Japan ..... 6-260299

[51] Int. Cl.[6] ..... H01J 29/07

[52] U.S. Cl. ..... 313/402; 313/403; 313/407

[58] Field of Search ..... 313/402, 407, 313/403, 408, 482

[56] References Cited

U.S. PATENT DOCUMENTS

| | | | |
|---|---|---|---|
| 4,286,189 | 8/1981 | Koizumi | 313/407 |
| 4,390,809 | 6/1983 | Mitchell et al. | 313/482 |
| 5,210,459 | 5/1993 | Lee | 313/407 |
| 5,214,349 | 5/1993 | Sakata et al. | 313/407 |
| 5,309,059 | 5/1994 | Kume et al. | 313/403 |
| 5,336,962 | 8/1994 | Keller | 313/402 |
| 5,384,511 | 1/1995 | Fujimara | 313/402 |
| 5,525,859 | 6/1996 | Ito et al. | 313/403 |
| 5,550,428 | 8/1996 | Kume et al. | 313/407 |

FOREIGN PATENT DOCUMENTS

| | | |
|---|---|---|
| 60-6066 | 2/1985 | Japan . |
| 4-126341 | 4/1992 | Japan . |

*Primary Examiner*—Sandra L. O'Shea
*Assistant Examiner*—Joseph Williams
*Attorney, Agent, or Firm*—Oblon, Spivak, McClelland, Maier & Neustadt, P.C.

[57] ABSTRACT

A color selecting electrode assembly for color cathode ray tubes which includes an apertured grill composed of fine-strand grids, a frame over which the aperture grill is stretched and which provides a tensioning force to the apertured grill, and a supporting structure body which is mounted at one end to said frame and engages the other end with the panel side wall of a color cathode ray tube so as to support said frame, wherein the wall thickness of said apertured grill is not greater than 0.032 mm. To assure the characteristic frequency of the aperture grill, it becomes unnecessary to manufacture individually frames having rigidities corresponding to respective slit pitches of the apertured grill. The frame can be a general purpose one (i.e., one used in common with others), thereby allowing the manufacture to be simplified. Further, the suppoting member can be also used in common with others, thereby allowing the design to be simplified.

7 Claims, 11 Drawing Sheets

STRUCTURE OF COLOR SELECTING ELECTRODE ASSEMBLY FOR COLOR CATHODE RAY TUBES

BACKGROUND OF THE INVENTION

The present invention relates to a structure of a color selecting electrode assembly body for color cathode ray tubes.

A general configuration of a conventional color selecting electrode assembly for color cathode ray tubes is shown in a perspective view of FIG. 10. Numeral 1 designates an aperture grill in which many thin grids forming slits are arranged; 2, a frame composed of a pair of holding members 21 fixed at one end to the aperture grill 1, and a pair of elastic members 22 for developing a predetermined stretching force on the aperture grill 1, which is arranged across the holding members 21 and fixed to the holding members 21; 3, a supporting member which is fixed at one end to the frame 2, and has an engaging hole 311 at the other end for engaging with a pin (not shown) buried in a panel which is a part of the glass bulb of a color cathode ray tube; 4, a high-expansion plate which is fixedly welded to the elastic members 22 of the frame 2, and forms a bimetal structure with the elastic members 22; 5, a damper wire which is arranged in a manner to contact the above-mentioned aperture grill, and serves to damp the vibration of the aperture grill; and 6, a damper spring for serving to add a predetermined tension to the damper wire 5. Now, the supporting member 3 is composed of a spring 31 for generating a spring action, and a metallic plate 32 for connecting the spring with the frame 2.

The aperture grill 1 is made of, for example, a high-purity thin iron plate, and provided with slits by being bored by means of the chemical etching. The interval between adjacent slits is called a pitch, and generally, the aperture grill having a slit pitch of 0.4 mm or less is used for display monitors; that having a slit pitch of about 0.4 to 0.6 mm is for high-definition televisions; and that having a slit pitch of 0.6 mm or more is for general televisions. Although the thickness of the aperture grill used is about 0.1 to 0.13 mm, the aperture grill leading the market currently has a thickness of 0.1 mm.

The holding member 21 of the frame 2 has an L-shaped section, and is welded at one end to the aperture grill 1. The holding member 21 is manufactured by a method in which a raw material is drawned in such a manner that it is allowed to pass through a mold having a predetermined section shape for the holding member 21, and then cut and bent to be formed into a final shape; a method in which a flat plate is roll-formed to be formed to a predetermined section and curvature, and then cut and bent to be formed into a final shape; or the like. The elastic members 22 is manufactured in such a manner that a hollow or solid bar is cut, and then bent by a press to be formed into a final shape. A pair of the holding members 21 and a pair of the elastic members 22 thus manufactured separately are arranged oppositely to each other, and fixedly welded. For the welding, in this case, an arcwelding such as the inert gas shielded tungsten arc welding is used.

Also, the shape of the frame 2 is designed so that the frame 2 has an optimum structure to develop a predetermined tension on the aperture grill 1. A general method of giving a tension to the aperture grill 1 is the one in which a predetermined displacement is allowed to develop previously on the frame 2 by an external force, then the aperture grill 1 is welded to the frame 2, and then the external force previously having been given to the frame 2 is released, and utilizing a restoring force of the frame which tends to return to the original position, a tension is allowed to develop on the aperture grill. At this point, those required for the frame structure are a rigidity enough to withstand the stretching force and a displacement at the stretching required to generate a stable stretching force. If a displacement at the stretching is a little, a little change during the process will cause the tension developed on the aperture grill to be largely changed.

The tension required for the aperture grill is generally determined by a characteristic frequency of a grid. Where the length and material of the grid have been predetermined, the relationship between the tension per grid and the characteristic frequency is expressed in the following equation (1):

$$T=k\times S\times f^2 \quad (1)$$

where T is the tension; k is the constant determined by the length and material character of the grid; S is the cross-sectional area of the grid; and f is the characteristic frequency. That is, in order to assure a predetermined characteristic frequency, the larger the cross-sectional area is, the more the tension must be increased. The total tension required for the entire color selecting electrode assemblies with the same external shape size depends on the slit pitch of the grid and on the cross-sectional area per grid, so that the larger the grid occupying area per unit length in the grid arranged direction is, the larger the required tension becomes. When the required tension becomes larger, the rigidity required for the frame becomes higher, so that the frame becomes tough and heavy. Such a heavy weight causes a deformation due to a vibration during manufacture process and a shock during transportation, whereby the color purity of color cathode ray tubes is deteriorated.

As a method of reducing the cross-sectional area of the aperture grill to reduce the required tension, there is disclosed a method of thinning the thickness of the aperture grill to 0.050 mm or less, in Japanese Unexamined Patent Publication No. 126341/1992.

Also, where even when a material with the same thickness is used, the slit pitch is different from each other, the cross-sectional area per unit length in the direction perpendicular to the longitudinal direction of the grid of the aperture grill 1 is largely different from each other. For example, where the thickness is 0.1 mm and the slit pitch is 1.0 mm, the grid has about twice the area per unit length and also requires about twice the tension, compared to a case where the slit pitch is 0.27 mm. For this reason, those having different slit pitches, even though they have the same external shape size, have different rigidities required for their frame, so that the frame matching the slit pitch have to be individually manufactured, thereby causing a loss and a reduced productivity. Even with the thickness of 0.05 mm specified in Japanese Unexamined Patent Publication No. 126341/1992, there is about 30% variation in the required tention for the slit pitch range of 0.25 to 1.00 mm, so that it is difficult for one frame to correspond to all slit pitches, and thus frames having two to three kinds of strength must be manufactured.

Further, the frame 2 is manufactured by machining separately the holding member 21 and the elastic member 22 and then welding them together, as described above, so that the manufacturing cost is very expensive. To solve this problem, there has been proposed the use of an integrally formed frame which has a good productivity and attains a simplified manufacture and a reduced cost, as shown in FIG. 11 of Japanese Examined Patent Publication No. 6066/1985. The frame 2 is composed of aperture grill welded sides 23 to which the aperture grill 1 is mounted and which are a pair of frame sides placed oppositely to each other, and aperture grill non-welded sides 24 which are arranged in the direction substantially perpendicular to the aperture grill welded sides 23 and are a pair of frame sides placed oppositely to each other. The frame 2 is composed of skirt portions (231 and 241) extending at all portions in substantially parallel to the tube axis of a color cathode ray tube, and flange portions (232 and 242) extending inwardly from the skirt end farthest from the above-mentioned aperture grill 1 in the direction substantially perpendicular to the tube axis of the color cathode ray tube. The skirt portion 241 of the aperture grill non-welded side 24 is provided with a notch 2411 for gaining a displacement at the ends of the aperture grill welded side 23 when the aperture grill 1 is stretched.

The frame 2 shown in FIG. 10 is manufactured by forming separately the holding member 21 and the elastic member 22 and then combining them with each other, so that there is less shape restriction in forming, and the dimensions of each portion can be set individually according to a required rigidity. On the contrary, the integrally structured frame as shown in FIG. 11 has a precondition that it is formed from a sheet of plate by pressing, so that there are many shape restrictions in forming, and thus a material is arranged even in a portion for which such a material is not required with respect to rigidity. As a result, the weight becomes heavier by about 20% compared to the structure of the frame shown in FIG. 10. If such an integrally formed frame is introduced in a condition that the currently required tension is kept, the weight becomes heavier and thus a deformation due to a vibration developed during process or a shock developed during transportation is increased, thereby causing a color purity as color cathode ray tubes to be deteriorated. For this reason, in current situation, a frame composed of the holding member 21 and the elastic member 22 as shown in FIG. 10 is widely used, while an integrally structured frame as shown in FIG. 11 is used only for small-size applications.

In the integrally structured frame, as shown in Japanese Examined Patent Publication No. 6066/1985, the skirt portion 241 of the aperture grill non-welded side 24 is provided with the notch 2411 for securing a displacement at side ends when the aperture grill welded side 23 is stretched. However, only with such a structure, the side ends have different displacements with respect to the central portion, thereby exhibiting a poor balance condition. This also prevents the integrally structured frame from being introduced. A problem exists that the stress developed when the aperture grill is stretched is concentrated on the aperture grill non-welded side 24, so that it is necessary to increase the rigidity, and thus the increase of the thickness of the entire frame causes an increased weight.

Where the frame is manufactured by being integrally formed by the use of a press, if a complete plate, as it is, is pressed, a raw material having a weight two to three times that of an actual product is required because the inside of the flange portion must be largely cut down so as to allow an electron beam to pass through the frame. This causes a problem that with the method, even though the cost for machining can be reduced, the cost for material loss is large, and as a result, the integrally structured frame cannot be manufactured at a lower cost. For this reason, it might be considered that the frame is manufactured by using the plate material obtained by welding a plurality of plates into a picture frame shape to reduce material loss. However, in this case, a crack in welded portions is apt to occur due to a stress or the like developed when an aperture grill is stretched.

A conventional color selecting electrode assembly for color cathode ray tubes has been configured as described above, so that when even those having the same external shape size have different slit pitches, the tensions required have been largely different from each other, and thus the frames exclusive for respective slit pitches have to be manufactured. A loss has occurred because one kind of frame cannot be used in common to each other, so that it has been required that one kind of frame is made common to improve the productivity and simplify the manufacture.

Also, a problem has existed that, in a condition that a required tension is large and thus the weight of the frame becomes heavier, a further weight increase resulting from the integral structure of the frame leads to a deteriorated characteristics of color cathode ray tubes, so that there must be used a frame which has a structure obtained by machining separately a holding member and an elastic member, which makes the manufacture complex.

Further, the integrally structured frame which can be easily manufactured has a problem that, for example, there has been a large difference in dispalcedment between the central part and the end of the frame side to which the aperture grill is welded, so that the tension of the aperture grill has been apt to deviate, and therefore the characteristics of the frame has been unstable.

The present invention is made to solve the above-mentioned problems, and it is an object of the present invention to obtain a color selecting electrode assembly for color cathode ray tubes in which those having the same external shape size even though the slit pitches thereof are different from each other can employ one kind of frame in common (changing of frame to general purpose one) to improve the productivity and simplify the manufacture. Further, it is another object of the present invention to improve the characteristics of the integrally structured frame which is suitable for the above purpose and can be easily manufactured, and to obtain a high-quality color selecting electrode assembly for color cathode ray tubes.

SUMMARY OF THE INVENTION

The color selecting electrode assembly for color cathode ray tubes according to claim 1 of the present invention comprises an aperture grill, a frame over which the aperture grill is stretched, and a support member for supporting the frame, wherein the thickness of the aperture grill is made at most 0.032 mm.

The color selecting electrode assembly for color cathode ray tubes according to claim 2 of the present invention comprises an integrally structured frame which is composed of skirt portions extending in parallel to a tube axis and flange portions inwardly extending towards the tube axis, which has notches in the end faces of the skirt portions of one pair of frame sides in a picture frame shape opposite to each other, and which gives a tension to a aperture grill stretched across the end faces of the skirt portions of the other pair of frame sides, wherein the frame has a structure in which the width of the skirt portions of one pair of frame sides over which the aperture grill is stretched is made narrower at the central part of the frame side than at the end thereof.

The color selecting electrode assembly for color cathode ray tubes according to claim 3 of the present invention comprises an integrally structured frame having a structure in which the ratio of the width of the flange portions to the width of the skirt portions at the central part of one pair of frame sides over which the aperture grill is stretched is made larger than the ratio at the end of the frame sides.

The color selecting electrode assembly for color cathode ray tubes according to claim 4 of the present invention is provided with an inwardly bent portion which is connected to the flange portion of an integrally structured frame and extendedly provided in the direction away from the aperture grill.

The color selecting electrode assembly for color cathode ray tubes according to claim 5 of the present invention has a structure in which the inwardly bent portion in claim 4 is provided on at least either of the flange portion of the frame sides which are opposite to each other and over which the aperture grill is not stretched, and the corner part.

The color selecting electrode assembly for color cathode ray tubes according to claim 6 of the present invention has a structure in which a strength reinforcing component having a L-shaped or turned-sideways U-shaped section is welded to the flange portion of the frame sides which are opposite to each other and over which the aperture grill is not stretched.

The color selecting electrode assembly for color cathode ray tubes according to claim 7 of the present invention employs a frame manufactured by using plate material formed by welding a plurality sheets of plate into a picture frame shape, and integrally forming the material with a press in such a manner that the welded part is placed on the frame side over which the aperture grill is stretched, of two pairs of frame sides of the frame which are opposite to each other.

In the present specification, the width of the skirt portion means a length in parallel to (substantially parallel to) the tube axis, and the width of the flange portion means a length in the direction substantially perpendicular to the tube axis.

In the color selecting electrode assembly for color cathode ray tubes according to claim 1 of the present invention, the thickness of the aperture grill is made 0.032 mm or less, and as described in detail later, a difference in the aperture grill occupying area per unit length which occurs in the case of the same external shape size and different slit pitches can be made within 5%, so that even when the slit pitches of the aperture grill are different from each other, a required characteristic frequency of the aperture grill can be assured with substantially the same tension. As a result, to assure the characteristic frequency of the aperture grill, it becomes unnecessary to manufacture individually frames having rigidities corresponding to respective slit pitches of the aperture grill. The frame can be made the general purpose one (the one used in common to each other), thereby allowing the manufacture to be simplified. Further, the supporting member can be also used in common to each other, thereby allowing the design to be simplified.

Also, compared to the conventional structure, the tension required to stretch the aperture grill is reduced by 20% or more, so that even if an integrally structured frame is employed, the weight does not become heavier than that of the conventional frame, and thus the characteristics of color cathode ray tubes are not deteriorated, thereby allowing the integrally structured frame to be applied. Further, the frame can be manufactured by press working, thereby causing a simplified machining and an improved productivity. Thus, a good productivity and a simplified manufacture, which are the features of the integrally structured frame, can be exhibited.

In the color selecting electrode assembly for color cathode ray tubes according to claim 2 of the present invention, the width of the skirt portion of the frame side on which the aperture grill of the integrally structured frame is stretched, for example, welded becomes narrower at the central part than at the end thereof, so that in the central part of the frame side, the distance between the top end of the skirt portion to which the aperture grill has been welded and the boundary portion with the flange portion becomes shorter than that of conventional frame, whereby a moment force developed by the tension of the aperture grill is reduced and thus the displacement becomes less. As a result, the displacement of the central part of the frame side, which has been developed largely compared to that of the end of the frame side, is reduced, thereby causing the displacement balance between the end and the central part of the frame side to be improved. Thus, a color cathode ray tube having stable characteristics of reduced tension variation can be obtained.

In the color selecting electrode assembly for color cathode ray tubes according to claim 3 of the present invention, the ratio of the width of flange portion to that of the skirt portion of the frame side to which the aperture grill is, for example, welded, of the integrally structured frame is made larger at the central part than at the end of the frame side. Accordingly, the displacement due to the bending stress developed by the tension of the aperture grill at the central part of the frame side becomes less, so that the displacement balance between the end and the central part of the frame side is improved. Thus, a color cathode ray tube having stable characteristics of reduced tension variation can be obtained.

In the color selecting electrode assembly for color cathode ray tubes according to claim 4 of the present invention, by the inwardly bent portion which is provided connectedly to the flange portion of the integrally structured frame, the rigidity can be improved enough to correspond to the tension of the aperture grill. The stress developed in the frame by the tension required for the stretching of the aperture grill is reduced, and thus the thickness of the entire frame can be thinned, thereby achieving the weight reduction of the product and resource saving of the product.

Also, by arranging the inwardly bent portion on the frame side over which the aperture grill is not stretched and on the corner part on which a stress is concentrated due to the tension of the aperture grill, the rigidity of places where the stress becomes a problem can be efficiently improved. A high stress developed in the frame by the tension required for the aperture grill stretching can be efficiently reduced.

In the color selecting electrode assembly for color cathode ray tubes according to claim 6 of the present invention, a strength reinforcing component having a L-shaped or turned-sideways U-shaped section is welded to the flange portion of the frame sides which are opposite to each other and over which the aperture grill is not stretched, so that the stress developed in the frame by the tension of the aperture grill can be reduced. Also, the strength reinforcing component becomes lighter in weight and higher in rigidity, and the thickness of the frame and the strength reinforcing component can be thinned, thereby achieving the weight reduction of the product and resource saving.

In the color selecting electrode assembly for color cathode ray tubes according to claim 7 of the present invention, the integrally structured frame is manufactured by using plate material formed by welding a plurality sheets of palate into a picture frame shape, so that the material loss inside the flange (the inside of the flange becomes unnecessary for single sheet of plate) can be reduced. Also, the welded part of the plate is positioned on the frame side on which a stress developed is relatively low and the aperture grill is not stretched, so that the welded plate material can be used without developing a problem such as a crack in the welded part.

DETAILED DESCRIPTION

EXAMPLE 1

Figure 1:
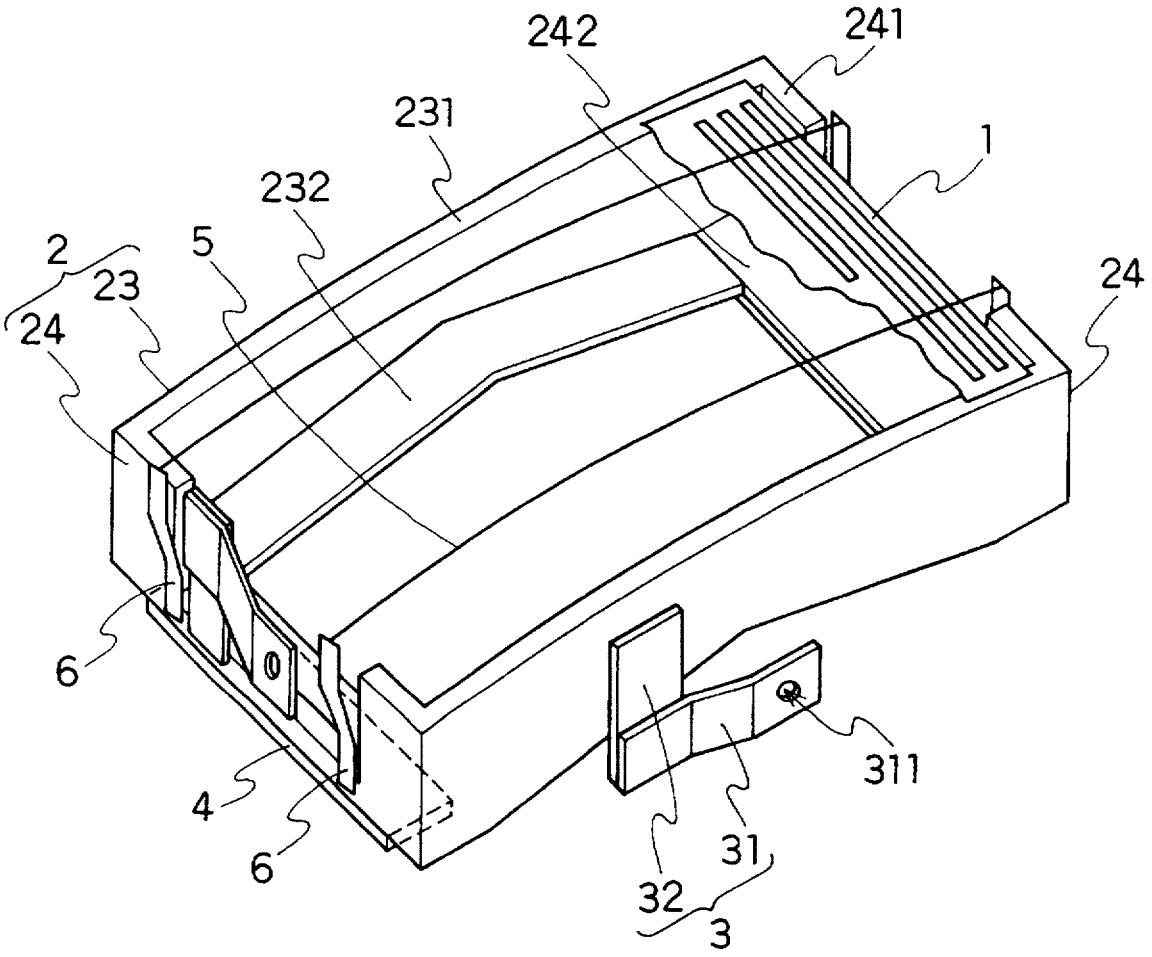
FIG. 1 is a partially cut-away perspective view showing a color selecting electrode assembly for color cathode ray tubes according to Example 1 of the present invention.

With reference to the perspective view showing a partially cut-away internal portion of FIG. 1, the color selecting electrode assembly for color cathode ray tubes according to Example 1 of the present invention will be explained hereinafter. This Example shows the color selecting electrode assembly for color cathode ray tubes used in a 21-inch display monitor, in which the slit pitch of an aperture grill 1 is 0.30 mm, and the thickness is 0.025 mm. A frame 2 is formed by forming integrally a raw material of 3 mm thickness by pressing into a picture frame shape. The frame 2 is composed of aperture grill welded sides 23 over which the aperture grill 1 is stretched by welding and which are a pair of frame sides placed oppositely to each other, and aperture grill non-welded sides 24 which are arranged between the aperture grill welded sides 23 and are a pair of frame sides placed oppositely to each other. The frame sides are composed of the skirt portions 231, 241 and the flange portions 232, 242. The skirt portion of respective frame side is mounted with a supporting member 3 composed of a spring 31 and a metallic plate 32. A fitting hole 311 of the spring 31 engages with a pin (not shown) buried in a panel which is a part of the glass bulb of a color cathode ray tube to lock the aperture grill 1 to a predetermined position. A flange portion 242 of the aperture grill non-welded sides 24 of the frame 2 is fixedly welded with a high-expansion plate 4. A damper wire 5 which is arranged in a manner to contact the aperture grill and serves to damp the vibration of the aperture grill is connected to a damper spring 6 for serving to add a predetermined tension to the damper wire 5, which is fixed to the flange portion 242.

Figure 2:
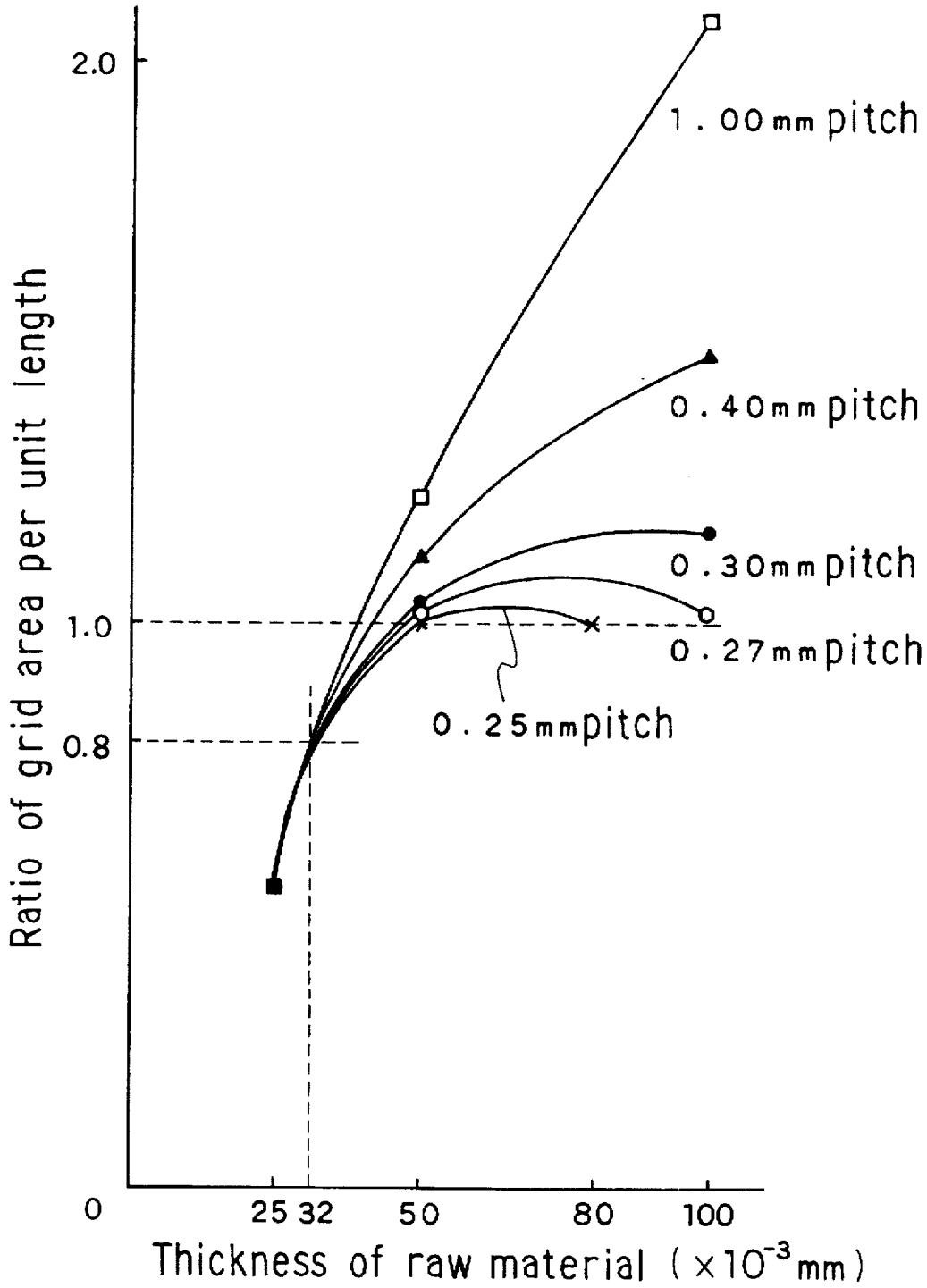
FIG. 2 is a graph showing the relationship between the thickness of a raw material of an aperture grill and the grid area per unit length using a slit pitch as a parameter.
Figure 3:
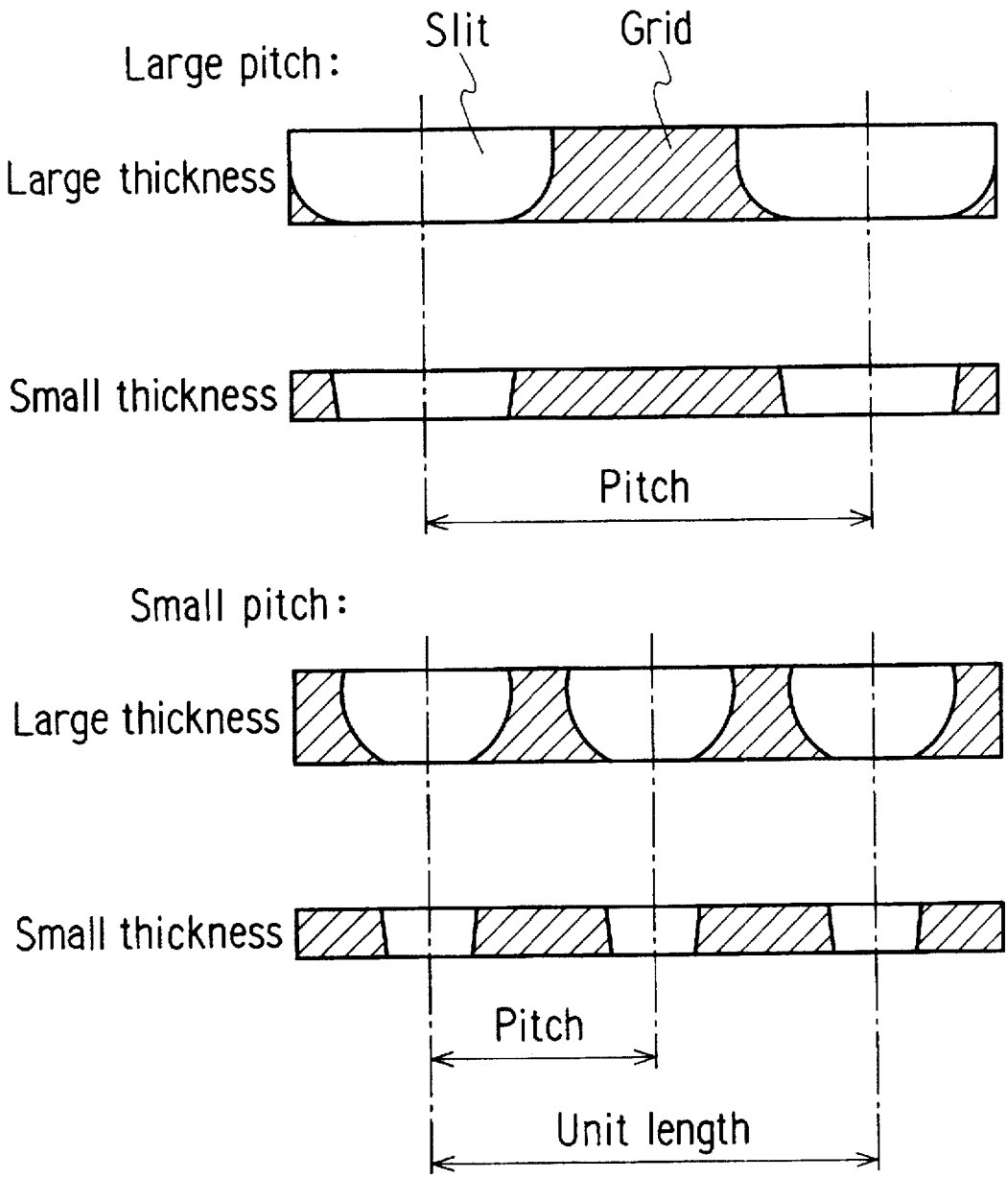
FIG. 3 is a cross-sectional view showing the relationship between the slit and the grid shape where the slit pitch and thickness of the aperture grill are different from each other.
Figure 4A:
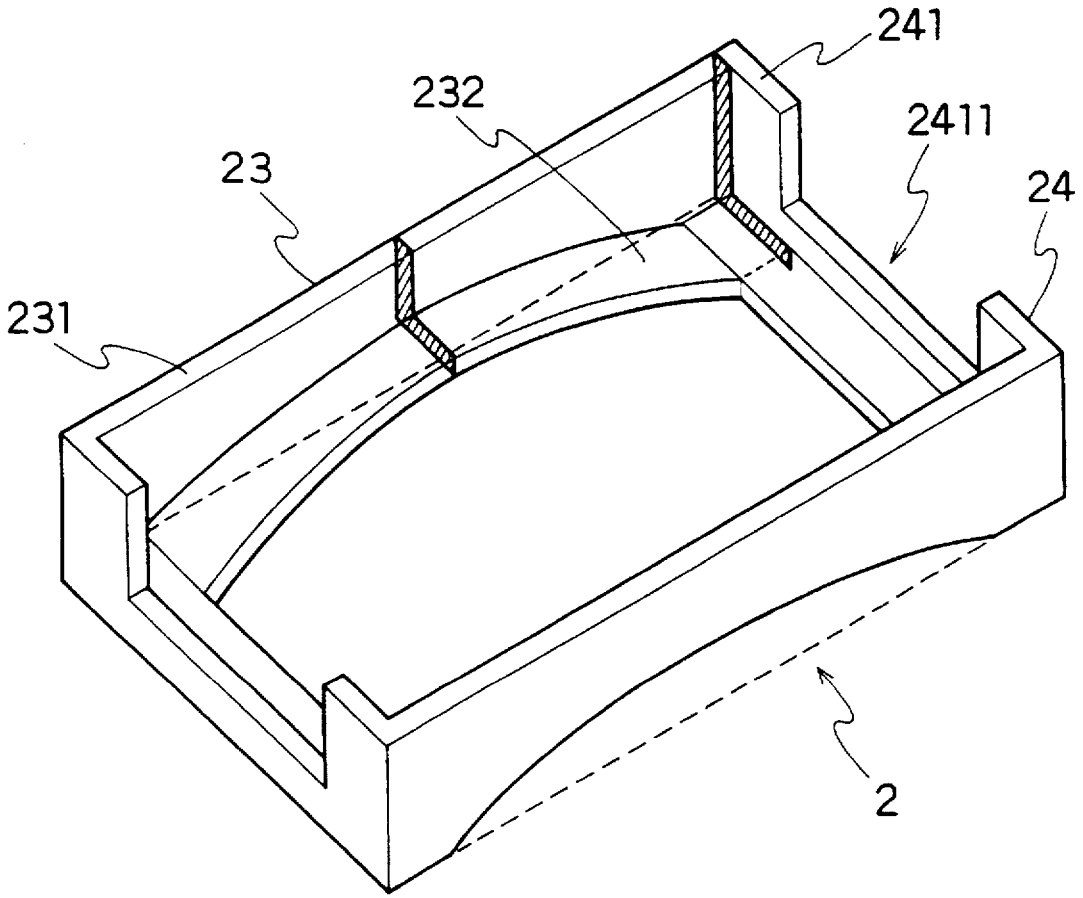
FIG. 4 is a perspective view showing a frame of a color selecting electrode assembly for color cathode ray tubes according to Example 2 of the present invention.
Figure 4B:
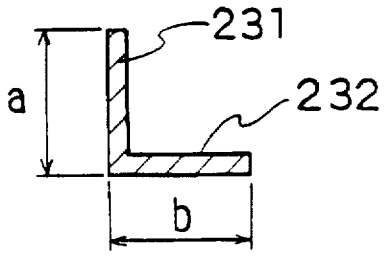
Figure 4C:
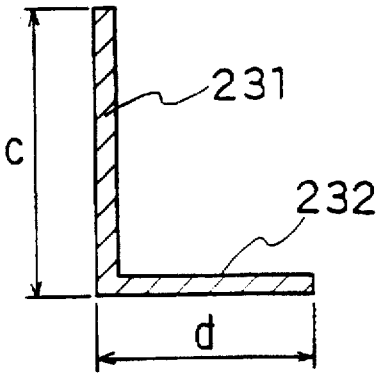
Figure 4D:
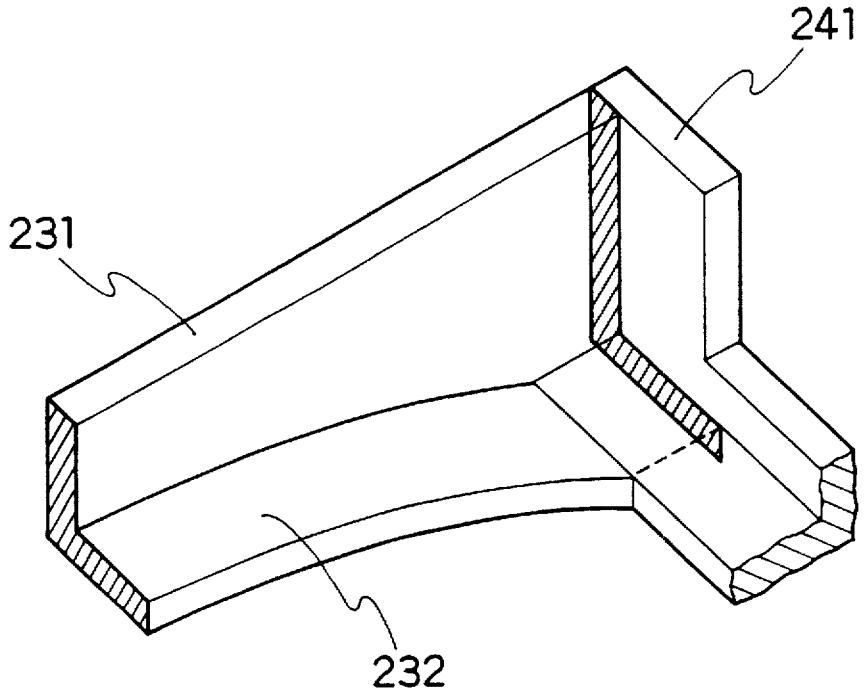

Now, as described above, as a method of reducing the cross-sectional area of the aperture grill to reduce a required tension, there has been proposed a method of thinning the thickness of the aperture grill. However, as a result of earnest investigation, there has been found that as shown in FIG. 2, if slit pitches are different from each other, the tendency of the reduction in area toward the reduction in raw material thickness becomes different in practice. FIG. 2 is a characteristic graph showing the relationship between the thickness of a raw material of the aperture grill and the grid area per unit length. In FIG. 2, the axis of ordinate represents a ratio of the grid area per unit length which ratio is a value obtained by dividing the cross-sectional area per grid by the slit pitch, and the axis of abscissa represents a thickness of a raw material of the aperture grill. The relationship between the ratio and the thickness is plotted for the slit pitch within a range of 0.25 mm to 1.00 mm. Where the slit pitch is large, the cross-sectional area per unit length is reduced substantially in proportion to the thickness, while where the slit pitch is small, the cross-sectional area per unit length tends not to be reduced unless the thickness becomes thin to some extent. This is because the aperture grill is manufactured by means of the chemical etching, and because a large thickness causes electron beam to be hit against and reflected from the side wall of the section, so that the larger hole side is required to be largely removed in such a manner that electron beam is not hit against the side wall for the large thickness. The cross-sectional shape of the slit and grid, where the thickness and slit pitch of the aperture grill vary, varies as shown in the schematic sectional explanatory view of FIG. 3. Where the thickness is small, the grid area per unit length is almost the same regardless of slit pitch, while when the thickness becomes large, the grid area per unit length in the case of small slit pitch becomes smaller than that in the case of the large slit pitch.

Then, in this Example, the thickness of the aperture grill is changed from 0.100 mm, which heretofore has been mainly used, to 0. 025 mm. As a result, as seen from FIG. 2, the grid area per unit length for the slit pitch of 0.03 mm in this Example was reduced to about 45% of the conventional area. Accordingly, even if the integrally structured frame is used, this allowed a sufficient strength with a weight of about 60% of the conventional frame to be obtained without making the weight heavier than the conventional frame.

Also, even for the 21-inch monitor for common color cathode ray tubes in which the slit pitch of the aperture grill 1 is coarse, the grid area per unit length is almost not changed, so that the frame with the above-mentioned configuration in this Example can be applied. It is not necessary to manufacture frames which are exclusive for respective slit pitches and have different frame strength. Further, the supporting member serves to lock the aperture grill mounted to the frame to a predetermined position, and in addition, to correct a reduced color purity due to deformation by the thermal expansion of the frame, and to perform a filter when an external vibration is transmitted to the aperture grill. Therefore if the shape of the frame is changed, the supporting member matching the frame have to be designed each time. However, those with the same size can be used in common to each other, so that the supporting member body could be also used in common to each other. Therefore, the design could be simplified to allow the manufacture to be simplified.

Further, although in this Example, the thickness of the aperture grill 1 is made 0.025 mm, by making the thickness of the aperture grill 0.032 mm or less, as shown in FIG. 2, the difference of the grid area per unit length developed where with the same external shape, the slit pitches are different can be put within 5%. Accordingly, like this Example, even if the slit pitches of the aperture grill 1 are different, the required characteristic frequency of the aperture grill can be secured with substantially the same tension. To secure the characteristic frequecy of the aperture grill, it becomes unnecessary to manufacture individually frames having a rigidity corresponding to the slit pitch of the aperture grill, so that the frame can be used in common to each other so as to be changed to general purpose one, thereby allowing manufacture to be simplified. Further, the supporting member can be used in common to each other, thereby allowing the design to be simplified.

EXAMPLE 2

With reference to FIG. 4, Example 2 of the present invention will be explained. FIGS. 4*a* to 4*c* show a frame structure of a color selecting electrode assembly for color cathode ray tubes, and the relationship between a skirt portion 231 and a flange portion 232 of a aperture grill welded sides 23 of a frame 2, in which FIG. 4*a* is a perspective view, FIG. 4*b* is a cross-sectional view of the central part of the aperture grill welded side, and FIG. 4*c* is a cross-sectional view of the end of the aperture grill welded side. Generally, by the relationship with the shape of color cathode ray tubes, the width of the skirt portion (the distance between the frame bottom and the skirt top end) becomes longer at the central part than at the end thereof. If the skirt portion 231 of the aperture grill welded sides 23 is raised above the frame bottom at all places, the width of the skirt portion at the central part will become longer than that at the end. Various analyses were performed in the present invention, with the result that it was found that in order to bring the displacements of the central part and the end of the aperture grill welded sides 23 close to each other, the height of the skirt portion 231 of the aperture grill welded sides 23 which is shorter at the central part is more advantageous than that which is longer at the central part. For this reason, in this Example, the skirt portion of the aperture grill welded sides 23 is formed into arch shape, whereby the length at the skirt portion is made shorter at the central part than at the end thereof. The width c of the skirt portion 231 at the end of the aperture grill welded sides 23 is about 40 mm, while the width a of the skirt portion 231 at the central part is made about 20 mm. Symbol b designates a width of the flange portion 232 at the central part of the aperture grill welded sides 23; and d designates a width of the flange portion 232 at the end.

On the contrary, it was found that in order to bring the displacements of the central part and the end of the aperture grill welded sides 23 close to each other, the width of the flange portion 232 which is as longer as possible is more advantageous than that which is shorter. However, if the flange portion is too long, electron beam will be blocked, which is a problem. In this Example, the aperture grill welded side 23 is allowed to have a curvature in a manner to expand outwardly, whereby the width of the flange portion 232 at the central part is made larger. As a result, although originally, the ratio of the length of the skirt portion 231 to that of the flange portion 232 is not so different at the central part (b/a) and at the end (d/c), in this Example, the ratio at the end is 0.75, while that at the central part becomes a larger value, i.e. 1.00. As described above, by making proper the width of the skirt portion 231, and the ratio of the width of the skirt portion 231 to that of the flange portion 232, the difference in displacement between the central part and the end, which was about four times for the conventional frame, becomes two times or less, thereby allowing a stable tension to be given to the aperture grill.

As described above, the width of the skirt portion 231 of the aperture grill welded side 23 of the integrally structured frame becomes narrower at the central part than at the end thereof, so that at the central part of the welded side 23, the distance between the top end of the skirt portion 231 to which the aperture grill 1 has been welded and the boundary portion with the flange portion 232 becomes shorter than that of conventional frame, whereby a moment force developed by the tension of the aperture grill 1 is reduced and thus the displacement becomes less. As a result, the displacement of the central part which has heretofor been developed largely compared to that of the end of the aperture grill welded side 23 is reduced, thereby causing the displacement balance between the end of the aperture grill welded side 23 and the central part thereof to be improved. Also, the ratio of the width of flange portion to that of the skirt portion of the aperture grill welded side 23 is made larger at the central part than at the end thereof, so that the displacement due to the bending stress developed by the tension of the aperture grill 1 at the central part of the aperture grill welded side 23 becomes less, thereby causing the displacement balance between the end and the central part of the frame side to be further improved. The difference in the displacement of the frame 2 due to the tension of the aperture grill 1 between the central part and the end is reduced, so that a color cathode ray tube having stable characteristics of reduced tension variation can be obtained.

EXAMPLE 3

Figure 5:
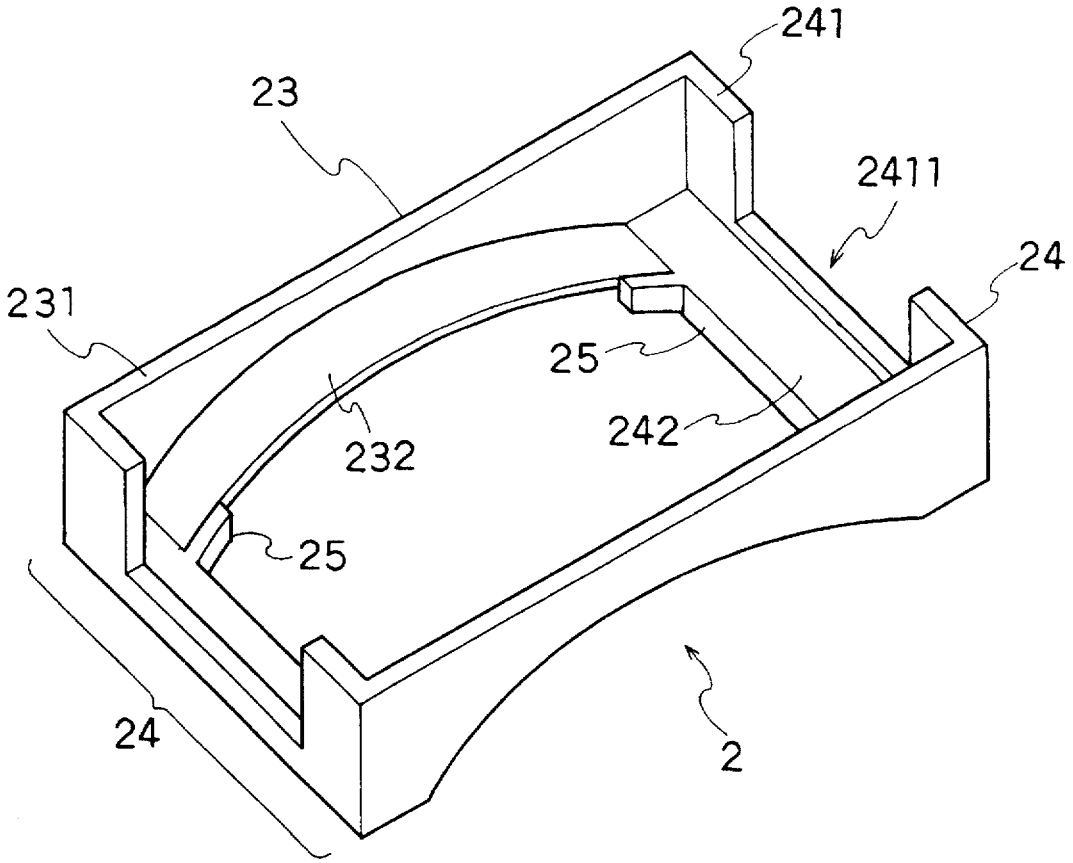
FIG. 5 is a perspective view showing a frame of a color selecting electrode assembly for color cathode ray tubes according to 3 of the present invention.

With reference to FIG. 5, a color selecting electrode assembly for color cathode ray tubes according to Example 3 of the present invention will be explained. FIG. 5 is a perspective view showing the frame structure, and provided in this Example an inwardly bent portion 25 extending in the direction opposite to the skirt portion from the aperture grill non-welded sides 24 and from the end of the flange portion at the corner part which is the end of the aperture grill welded side 23 and is the boundary part with the aperture grill non-welded sides 24. By providing the inwardly bent portion 25, the stress of the aperture grill non-welded sides 24 can be reduced without largely reducing the displacement of the end of the aperture grill welded side 23. The stress developed in the frame by the tension required for the stretching of the aperture grill 1 can be reduced, and thus the thickness of the entire frame to be thinned. As a result, the reduced weight and cost of the product can be achieved.

Although in FIG. 5, the inwardly bent portion 25 is arranged at a place with a high stress, the same effect is obtained even where the inwardly bent portion 25 is arranged on the full circumference of the flange portion. In this case, though there is a disadvantage that the entire weight becomes somewhat heavier, there is also an advantage that the frame is easily machined because the inwardly bent portion is continuous in structure.

Figure 6:
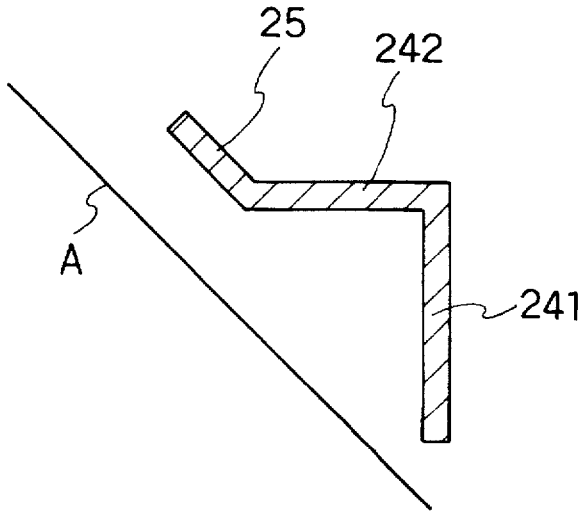
FIG. 6 is a cross-sectional view showing the relationship between the shape of the frame of the color selecting electrode assembly for color cathode ray tubes according to Example 3 of the present invention and an electron beam.

Also, in FIG. 5, the inwardly bent portion 25 is disposed in a manner to be opposite to the skirt portion and to become substantially perpendicular to the flange portion. However, it is not particularly necessary to extend the bent portion in the direction perpendicular to the flange portion, and the same effect is exhibited even where, for example, the bent portion is extended in the direction substantially parallel to the track A of electron beam as shown in the cross-sectional view of FIG. 6.

EXAMPLE 4

Figure 7:
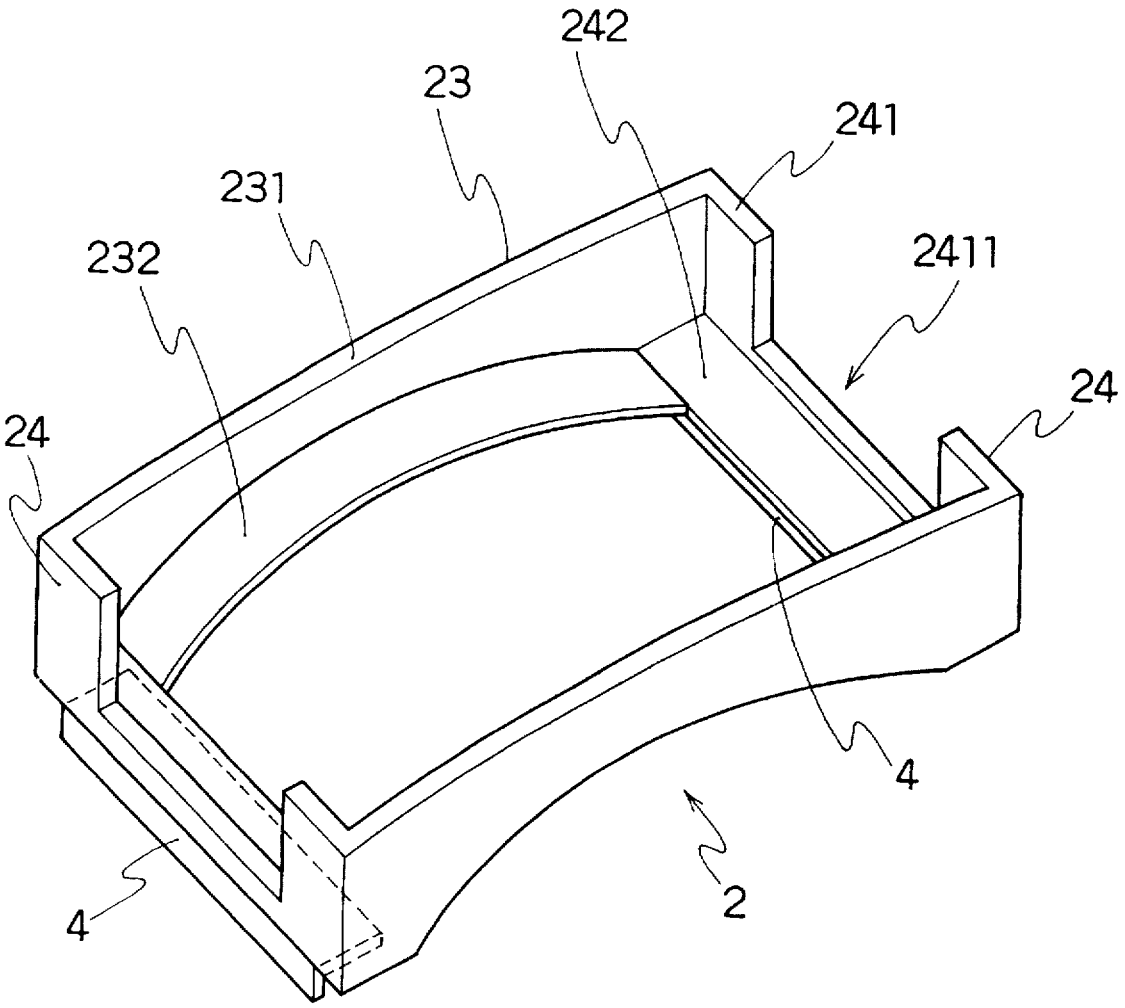
FIG. 7 is a perspective view showing a frame of a color selecting electrode assembly for color cathode ray tubes according to Example 4 of the present invention.

With reference to the perspective view showing the frame portion of FIG. 7, an Example 4 of the present invention will be explained. In this Example, the flange portion 242 of the aperture grill non-welded sides 24 of the frame 2 is mounted with the high-expansion plate 4 which is a strength reinforcing component and has a L-shaped section. The high-expansion plate 4 is arranged at a place at which a stress associated with the tension of the aperture grill 1 is high, so that in a sense, the plate becomes the strength reinforcing component of the frame 2. Also, in the conventional frame, a high-expansion plate is affixed to a similar place to serve to alleviate the tension reduction of the aperture grill associated with temperature rise. However, in this Example, by changing the cross-sectional shape from a simple square to the L-shape, the high-expansion plate having a lighter weight can be provided while keeping the rigidity of the high-expansion plate as the strength reinforcing component to the same extent. Further, the plate which is arranged in such a manner that the side wall comes to the outside, even with the same L-shaped section, can reduce the stress more largely than that arranged in such a manner that the side wall comes to the inside. The stress of the frame 2 can be reduced, and at the same time, the high-expansion plate 4 becomes light in weight and high in rigidity, and thus the thickness of the frame 2 and the high-expansion plate 4 can be thinned, thereby achieving a reduced weight and cost of the product.

For example, in a color selecting electrode assembly for color cathode ray tubes used in a 21-inch display monitor, the high-expansion plate 4 which has the same thickness of 3 mm as the frame, and has an L-shaped section is fixedly welded to the flange portion 242 of the aperture grill non-welded sides 24.

Figure 8A:
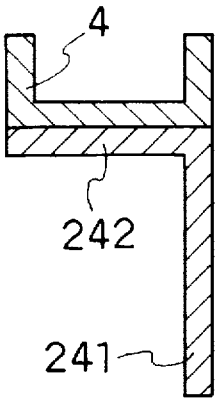
FIG. 8 is a cross-sectional view showing another example of the relationship between the frame of the color selecting electrode assembly for color cathode ray tubes according to Example 4 of the present invention, and the shape and position of a high-expansion plate.
Figure 8B:
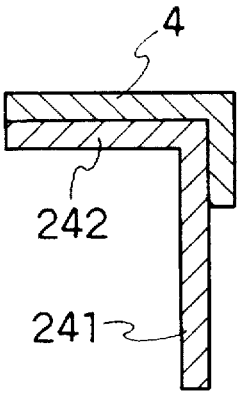
Figure 8C:
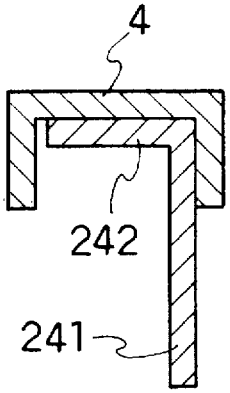

The cross-sectional shape of the high-expansion plate 4 is not limited to L-shape, and might be, for example, turned-sideways U-shape. For example, the cross-sectional shape and mounting method of the high-expansion plate 4 as shown in FIGS. 8*a*, 8*b*, and 8*c* might be also employed, which exhibits the same effect.

EXAMPLE 5

Figure 9:
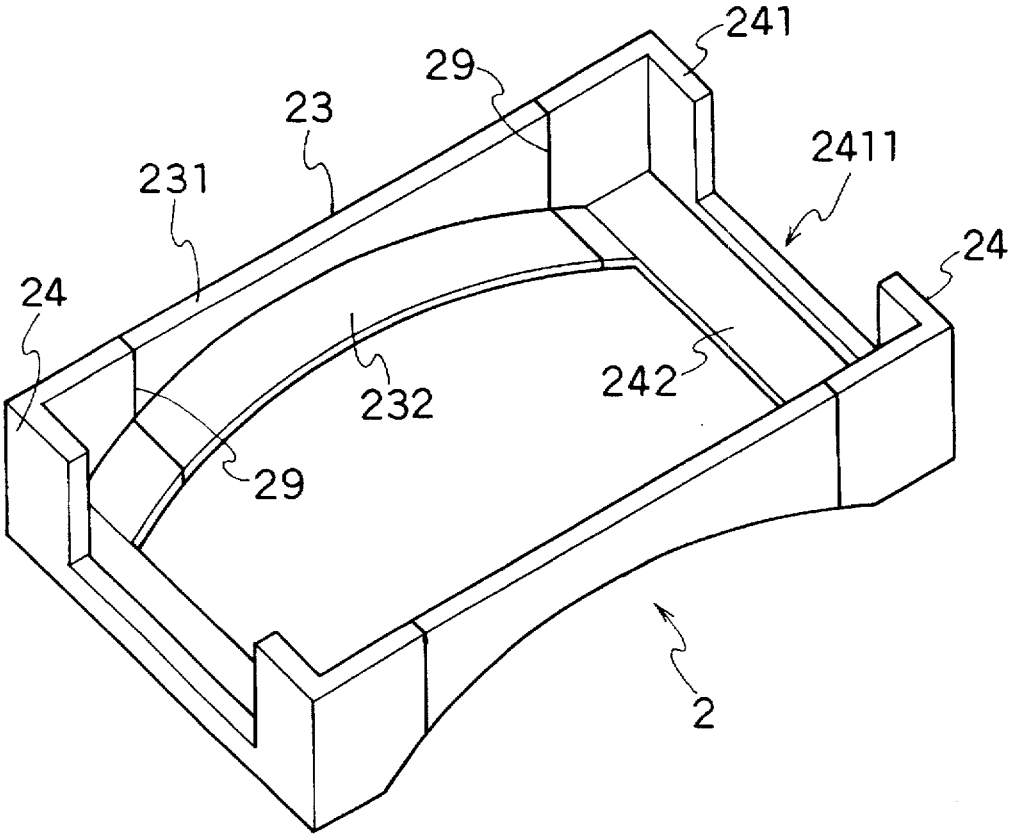
FIG. 9 is a perspective view showing a frame of a color selecting electrode assembly for color cathode ray tubes according to Example 5 of the present invention together with the welding seam of plate material.
Figure 10:
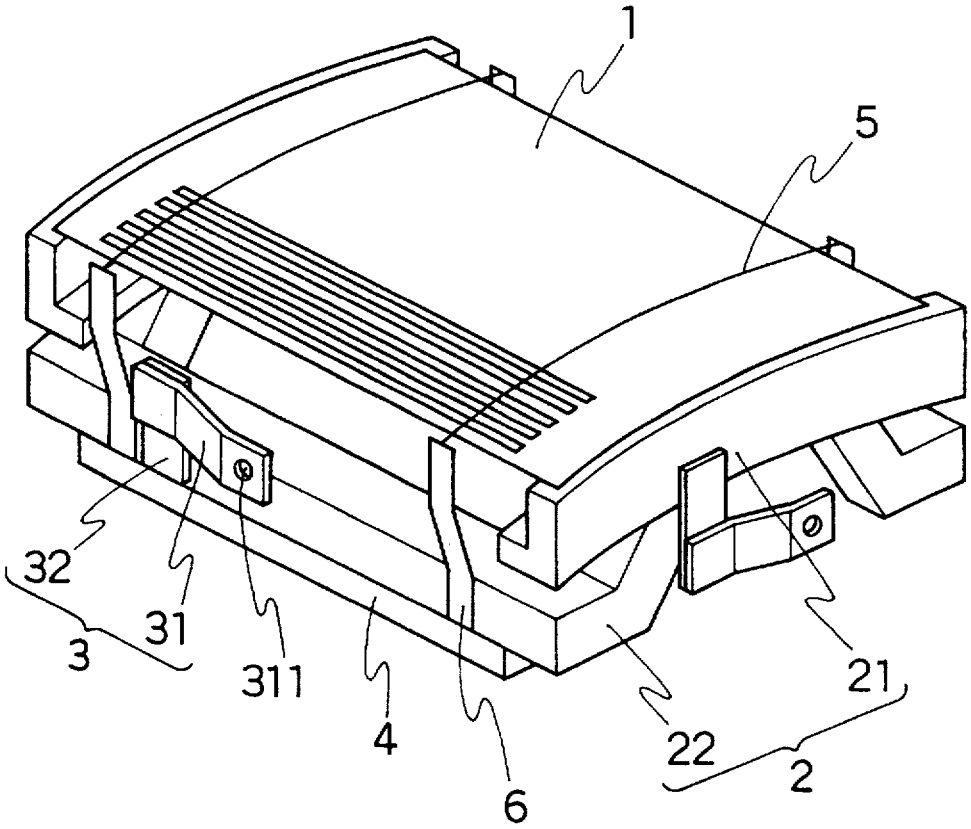
FIG. 10 PRIOR ART
FIG. 10 is a perspective view showing a conventional color selecting electrode assembly for color cathode ray tubes.
Figure 11:
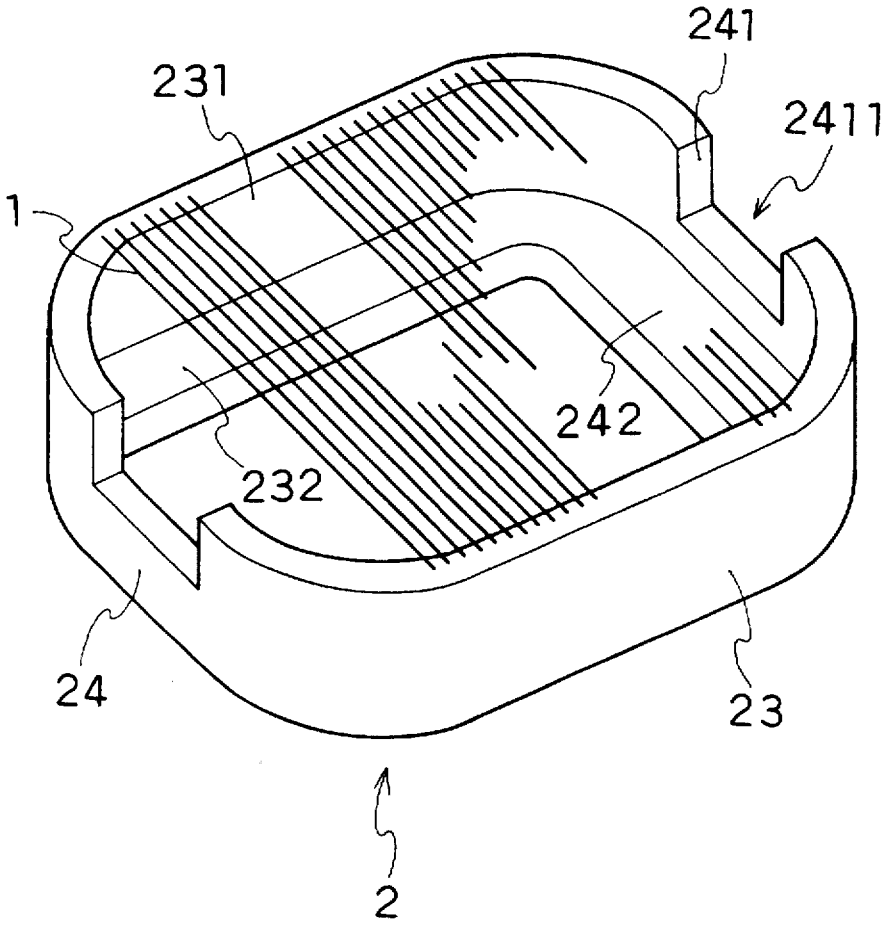
FIG. 11 is a perspective view showing another conventional color selecting electrode assembly for color cathode ray tubes.

With reference to the perspective view showing the frame of FIG. 9, Example 5 of the present invention will be explained. In FIG. 9, the frame 2 is obtained by welding four sheets of plate, cladding them into a picture frame shape to form a plate material, and pressing the plate material, wherein a welding seam 29 in the plate is arranged in a manner to come to the aperture grill welded side 23 of the frame 2 in which a stress developed due to the tension of the aperture grill 1 is low. In this Example, the frame is formed by the use of a plate material obtained by welding four sheets of plate into a picture frame shape, so that the ratio of the product to the material used is improved from about 40% to about 80%, thereby allowing the material loss and the material cost to be significantly reduced. Also, the welding seam 29, that is, the welding place is positioned on the aperture grill welded side 23 in which stress developed in the frame 2 due to the tension required to stretch the aperture grill 1 is low, so that no rupture or crack develops in the welded part, thereby causing the product to be obtained at a lower cost.

Also, although FIG. 9 shows a structure in which four sheets of plate are clad, the structure might be formed by cladding two sheets of L-shaped plate, by which the same effect is obtained.

Further, the present invention can suitably exhibit the effects sufficiently by combining the above-mentioned Examples without being limited to the above-mentioned Example only, for example, by applying the frame having the configuration of the above-mentioned Examples 2 and 3 to the integrally structured frame having the configuration of the above-mentioned embodiment 1.

As described above, in the color selecting electrode assembly for color cathode ray tubes according to claim 1 of the present invention, the thickness of the aperture grill is made 0.032 mm or less, so that in the frames with the same size and even having different slit pitches of the aperture grill, the tension required becomes substantially the same, and thus it becomes unnecessary to manufacture an exclusive frame for each slit pitch. Further, the frames can be used in common to each other and in addition, the supporting member can be also used in common, whereby there are effects of achieving a simplified design and a reduced cost.

Also, compared to the conventional structure, the tension required to stretch the aperture grill can be reduced by 20% or more, so that even if an integrally structured frame is employed, the weight does not become heavier than that of the conventional frame, and thus the characteristics are not deteriorated. Further, the frame can be manufactured by press forming, whereby a good productivity and a simplified manufacture, which are the features of the integrally structured frame, can be exhibited.

In the color selecting electrode assembly for color cathode ray tubes according to claim 2 of the present invention, the assembly comprises an integrally structured frame which is composed of skirt portions extending in parallel to a tube axis and flange portions inwardly extending towards the tube axis, which has notches in the end faces of the skirt portions of one pair of frame sides in a picture frame shape opposite to each other, and which gives a tension to the aperture grill stretched across the end faces of the skirt portions of the other pair of frame sides, wherein the frame has a structure in which the width of the skirt portions of one pair of frame sides over which the aperture grill is stretched is made narrower at the central part of the frame side than at the end thereof, so that the difference in the displacement of the frame due to the tension of the aperture grill between the central part and the end is reduced, and thus a color cathode ray tube having stable characteristics of reduced tension variation can be obtained.

In the color selecting electrode assembly for color cathode ray tubes according to claim 3 of the present invention, an integrally structured frame has a structure in which the ratio of the width of the flange portions to the width of the skirt portions at the central part of one pair of frame sides over which the aperture grill is stretched is made larger than the ratio at the end of the frame sides, so that the difference in the displacement of the frame due to the tension of the aperture grill between the central part and the end is reduced, and thus a color cathode ray tube having stable characteristics of reduced tension variation can be obtained.

In the color selecting electrode assembly for color cathode ray tubes according to claim 4 of the present invention, there is provided an inwardly bent portion which is connected to the flange portion of an integrally structured frame and extendedly provided in the direction away from the aperture grill, so that the stress developed in the frame by the tension required for the stretching of the aperture grill is reduced, and thus the thickness of the entire frame can be thinned, thereby achieving the weight reduction of the product and resource saving.

In the color selecting electrode assembly for color cathode ray tubes according to claim 5 of the present invention, by arranging the inwardly bent portion in claim 4 on the frame side over which the aperture grill is not stretched and on the corner part on which a stress is concentrated due to the tension of the aperture grill, the rigidity of places where the stress becomes a problem can be efficiently improved. A high stress developed in the frame by the tension required for the aperture grill stretching can be efficiently reduced.

In the color selecting electrode assembly for color cathode ray tubes according to claim 6 of the present invention, a strength reinforcing component having a L-shaped or turned-sideways U-shaped section is welded to the flange portion of the frame sides which are opposite to each other and over which the aperture grill is not stretched, so that the stress developed in the frame by the tension of the aperture grill can be reduced, and at the same time, the strength reinforcing component becomes lighter in weight and higher in rigidity, and the thickness of the frame and the strength reinforcing component can be also thinned. Thus, there are effects of achieving the weight reduction of the product and resource saving.

In the color selecting electrode assembly for color cathode ray tubes according to claim 7 of the present invention, the frame is manufactured by using plate material formed by welding a plurality sheets of plate, and integrally forming the material with a press in such a manner that the welded part is placed on the frame side over which the aperture grill is stretched, of two pairs of frame sides of the frame which are opposite to each other. Therefore, the material loss inside the flange (the inside of the flange becomes unnecessary for single sheet of plate) can be reduced, and the material cost can be also reduced. Also, the weld part of the plate is positioned on the frame side on which a stress developed is relatively low and the aperture grill is not stretched, so that the welded plate material can be used without developing a problem such as a crack in welded part.

Though several embodiments of the present invention are described above, it is to be understood that the present invention is not limited only to the above-mentioned and various changes and modifications may be made in the invention without departing from the spirit and scope thereof.

What is claimed is:

1. A color selecting electrode assembly for color cathode ray tubes comprising:

an apertured grill having a plurality of grids;

a frame over which the aperture grill is stretched and which applies a pretensioning force to the apertured grill; and a supporting member which is mounted at a first one end thereof to the frame and is engageable at a second end thereof with a panel side wall of a color cathode ray tube so as to support the frame, wherein the thickness of said apertured grill is at most 0.032 mm and wherein said frame has an arched skirt portion and an L-shaped member, said skirt portion and said L-shaped member together being L-shaped when viewed in cross section and wherein the height dimension of the skirt portion is shorter at a central part of a side of the frame than at an end thereof.

2. A color selecting electrode assembly for color cathode ray tubes comprising:

an apertured grill having a plurality of fine grids;

a frame having a first pair of sides with respective arched skirt portions, said skirt portions extending parallel to a tube axis of a color cathode ray tube and flange portions connected to the skirt portions and which extend inwardly towards the tube axis, said frame having a picture frame shape and having notches formed in end faces of the skirt portions wherein a pretensioning force is applied to the apertured grill and the apertured grill is stretched across the end faces of the skirt portions of a second pair of frame sides; and a supporting member mounted at a first end of the frame and which is engageable at a second end with a panel side wall of the color cathode ray tube so as to support the frame, wherein the height dimension of the skirt portions of said first pair of frame sides over which the aperture grill is stretched is shorter at a central part of the frame side than at an end thereof.

3. A color selecting electrode assembly for color cathode ray tubes comprising:

an apertured grill having a plurality of fine grids;

a frame having arched skirt portions extending parallel to a tube axis of a color cathode ray tube and flange portions connected to the skirt portions of a first pair of sides of said frame which extend inwardly towards the tube axis, said frame having a picture frame shape and including notches formed in end faces of the skirt portions, wherein a pretensioning force is applied to the apertured grill and the apertured grill is stretched across the end faces of the skirt portions of a second pair of sides of said frame; and a supporting member mounted at a first end to the frame and which is engageable at a second end with a panel side wall of the color cathode ray tube so as to support the frame, wherein the height dimension of the skirt portions at a central part of a side of the frame is shorter than at an end thereof and wherein a ratio of a width of the flange portions to the width of the skirt portions at a central part of said first pair of frame sides over which the aperture grill is stretched is larger than the ratio at one of said first and second ends of the frame sides.

4. A color selecting electrode assembly for color cathode ray tubes, comprising:

an apertured grill having a plurality of fine grids;

a frame having a plurality of skirt portions extending parallel to a tube axis of a color cathode ray tube and flange portions connected to the skirt portions which extending inwardly towards the tube axis, said frame having a picture frame shape and having notches formed in end faces of the skirt portions of a first pair of sides of said frame, wherein a pretensioning force is applied to the apertured grill and the apertured grill is stretched across the end faces of the skirt portions of a second pair of frame sides; and a supporting member mounted at a first end to the frame and which is engageable at a second end with a panel side wall of the color cathode ray tube so as to support the frame, wherein the frame has an inwardly bent portion which is connected to the flange portions of the frame and which extends in a direction away from the apertured grill.

5. A color selecting electrode assembly for color cathode ray tubes as claimed in claim 4, wherein the inwardly bent portion is provided on the flange portions of the frame sides which are opposite to each other and over which the aperture grill is not stretched, and on a corner part of the frame.

6. A color selecting electrode assembly for color cathode ray tubes, comprising:

an apertured grill having a plurality of fine grids;

a frame having a plurality of arched skirt portions extending parallel to a tube axis of a color cathode ray tube and flange portions connected to the skirt portions of a first pair of sides of said frame which extend inwardly towards the tube axis, said frame having a picture frame shape and including notches formed in end faces of the skirt portions, wherein a pretensioning force is applied to the apertured grill and the apertured grill is stretched across the end faces of the skirt portions of a second pair of sides of said frame and wherein the height dimension of the skirt portion at a central part of the frame is shorter than at an end thereof; and a supporting member mounted at a first end to the frame and which is engageable at a second end with a panel side wall of the color cathode ray tube so as to support the frame, wherein a strength reinforcing component having one of an L-shaped and a sideways-turned U-shaped section is welded to the flange portion of a portion of the frame sides over which the apertured grill of the frame is not stretched.

7. A color selecting electrode assembly for color cathode ray tubes, comprising:

an apertured grill having a plurality of fine grids;

a frame having a plurality of arched skirt portions extending parallel to a tube axis of a color cathode ray tube and flange portions connected to the skirt portions of a first pair of sides of said frame which extend inwardly towards the tube axis, said frame having a picture frame shape and including notches formed in end faces of the skirt portions, wherein a pretensioning force is applied to the apertured grill and the apertured grill is stretched across the end faces of the skirt portions of a second pair of sides of said frame and wherein the height dimension of the skirt portion at a central part of the frame is shorter than at an end thereof; and a supporting member mounted at a first end of the frame which is engageable at a second end with a panel side wall of the color cathode ray tube so as to support the frame, wherein the frame comprises a plate material formed by welding a plurality of sheets of plate into the picture frame shape, and the material is press molded in such a manner that the welded part is placed on the frame side over which the apertured grill is stretched.

* * * * *